US005727833A

United States Patent [19]

Coe

[11] Patent Number: 5,727,833

[45] Date of Patent: Mar. 17, 1998

[54] EYE-AND-EYE SLING

[75] Inventor: Kenneth A. Coe, Lebanon, Ind.

[73] Assignee: American Steel Investment Corporation, Fort Wayne, Ind.

[21] Appl. No.: 660,919

[22] Filed: Jun. 10, 1996

[51] Int. Cl.[6] ..... B66C 1/12

[52] U.S. Cl. ..... 294/74; 73/862.56

[58] Field of Search ..... 294/74; 73/862.53, 73/862.56, 862.392; 57/201, 210, 224

[56] References Cited

U.S. PATENT DOCUMENTS

| | | | |
|---|---|---|---|
| 3,079,192 | 2/1963 | Otley | 294/74 |
| 3,466,080 | 9/1969 | Norton | 294/74 |
| 3,718,945 | 3/1973 | Brindejonc De Treglode | 294/74 |
| 4,045,072 | 8/1977 | Brown | 294/74 |
| 4,757,719 | 7/1988 | Franke | 73/862.56 |
| 4,850,629 | 7/1989 | St. Germain | 294/74 |
| 5,415,449 | 5/1995 | Kentner, Sr. | 294/74 |

FOREIGN PATENT DOCUMENTS

| | | | |
|---|---|---|---|
| 203432 | 1/1955 | Australia | 294/74 |

OTHER PUBLICATIONS

Product brochure entitled "Products for the Wire Rope and Wire Rope Sling Industry," by American Wire Rope & Sling, Ft. Wayne & Indianapolis, IN, no date.

Product brochure entitled "Slingmax Rigging Products #9511," by Slingmax Rigging Products of Aston, PA, 1995.

*Primary Examiner*—Dean Kramer

*Attorney, Agent, or Firm*—Baker & Daniels

[57] ABSTRACT

An eye-and-eye sling in which the protective cover for an endless loop load bearing sling core is not provided with extraneous layers along the body of the sling that extends between the sling eyes. In the inventive sling, first and second loop segments of the load bearing core which are generally diametrically disposed are respectively encased within first and second seamless tubular eye covers. These loop segments and eye covers form the eye portions of the eye-and-eye sling. The spanning portions of the endless loop that are not covered by the eye covers are encased within a common seamless tubular body cover. The body cover and spanning loop segments generally form the body portion of the sling that extends between the sling eyes. The present invention also provides a bridle having an integral master ring and protective covers for the bridal legs in which excessive layers of cover material are avoided.

5 Claims, 5 Drawing Sheets

EYE-AND-EYE SLING

BACKGROUND OF THE INVENTION

The present invention pertains to slings, and, in particular, to eye-and-eye slings including bridles.

A variety of slings are commercially available which can be utilized to both lift and suspend relatively heavy objects. These slings may alternatively be employed as structural members in situations where large tensile loadings may occur. Prior art slings have been formed from an assortment of materials, including wire ropes, as is well known in the art, and endless loops of high-strength fiber windings encased within protective covers.

One particularly useful sling construction is disclosed in U.S. Pat. No. 4,850,629. This sling construction utilizes multiple, discrete load bearing cores formed of fiber windings which are separately encased within pathways provided in a common protective cover. The sling described therein is in the form conventionally known as an endless loop or round sling. Although round slings may find advantageous application in numerous situations, many users nonetheless prefer eye-and-eye slings. Past attempts to modify a round sling to realize an eye-and-eye sling have included arranging the endless loop in a substantially flat condition and then pulling a flexible tubular sleeve over the endless loop. The tubular sleeve, being shorter than the flattened endless loop, results in a portion of the sling being exposed at opposite ends of the sleeve, and these sling portions serve as eyelets. The tubular sleeve may then be securely fastened to the round sling such as by stitching.

While functional, round slings modified into eye-to-eye slings are not without their shortcomings. In particular, because the central length portion of the round sling covered by the tubular sleeve also includes the original protective cover of the load-bearing cores, the central portion of the modified round sling has numerous extraneous layers of fabric or cover which add unnecessary bulk. In applications where the sling is required to operate within space constraints, this additional bulk can be highly problematic. In addition, the inclusion of the extra cover material within the tubular sleeve also undesirably increases the weight and cost of manufacture of the sling.

With some existing slings, indicators have previously been provided which were intended to assist an operator in determining when the sling has been overstressed and has yielded beyond an acceptable limit. One type of indicator involves manufacturing a load bearing core from multiple windings of a fibrous material, and, after tying the fibrous material ends together when winding is complete, leaving one of the ends with a short extension. This short extension projects outward through the core protective cover to be visible to an operator. This extension, known in the art as a telltale, is intended to pull back into and disappear within the core cover when the sling overstretches so as to visually indicate to an operator that the round sling requires maintenance or replacement. One difficulty with this prior design is that because the extension is so short and extends along only a fraction of the core circumference, the possibility exists that during use the portion of the core to which the telltale is attached will not move enough to pull the tell-tail within the cover despite other portions of the core experiencing unacceptably large yielding or elongation.

To overcome this problem, one prior art device involves stringing a fiber optic cable around the entire length or circumference of the round sling and having opposite ends of the cable project from the core cover. An operator can verify that the fiber optic cable has not broken, which could occur during round sling stretching, by shining a light at one end of the cable and checking to make sure the light is visible at the opposite end of the cable. Failure of the cable to project outside of the protective cover also may indicate round sling stretching. While perhaps useful, this fiber optic design complicates manufacture and requires additional raw materials, which may increase the overall cost to potential users.

Still other types of slings are known as bridles. One end or part of a bridle typically attaches to a common hook for suspension, and the multiple bridle legs extend down to and attach at multiple points to an object being lifted or raised. To use existing slings in a bridle fashion, frequently an extra sling or a rigid master ring is employed. The extra sling or master ring is attachable to the suspending hook, and one or more slings forming the bridle legs are attached to the extra sling or ring. Besides potentially complicating operational assembly, the use of an additional sling or ring takes up vertical space.

Thus, it would be desirable to provide a sling which addresses these and other problems of the prior art.

SUMMARY OF THE INVENTION

The present invention pertains to eye-and-eye slings and bridles in which the provision of excessive layers of protective covering on the main portion of the sling or bridle between the eyed ends is avoided. This avoidance of excess cover layers reduces the bulk and weight of the sling while using similar materials of construction as in existing slings and without unduly compromising sling performance. The inventive slings can find advantageous application in situations where the extra bulk or weight of prior art slings precluded or hindered their ready utilization.

In one form thereof, the present invention provides an eye-and-eye sling including at least one flexible load bearing core in the form of an endless loop. First and second loop segments, the ends of which are spanned by first and second spanning segments of the loop, are generally diametrically disposed portions of the endless loop. The sling includes first and second eye covers that respectively cover the first and second loop segments and form first and second eyes of the sling. These eye covers do not cover the first and second spanning segments of the loop. The sling also includes a body cover around the first and second spanning segments of the loop, and the body cover and spanning segments comprise a body portion of the sling between the first and second eyes.

In another form thereof, the present invention provides a sling comprising a flexible load bearing core in the form of an endless loop including a plurality of windings of a strand of material, a flexible cover means for covering the load bearing core, and telltale means extending from the cover means. The telltale means includes an indicator strand connected to the strand of material, and the indicator strand extends around at least the entire length of the endless loop.

In still another form thereof, the present invention provides a multi-leg bridle including a plurality of flexible load bearing cores in the form of endless loops. The endless loops each include a length including a first loop segment, a second loop segment, a first spanning segment extending between first ends of the first and second loop segments, and a second spanning segment extending between second ends of the first and second loop segments. The first and second loop segments at least comprise substantially diametrically disposed portions of the endless loop. The bridle includes a common first cover covering the first loop segments of each of the plurality of endless loops and forming a bridle master ring, and a plurality of eye covers each covering one of the second loop segments of the plurality of endless loops and forming an eye of a leg of the bridle. The first and second spanning segments of each of the plurality of endless loops are not encased within either the plurality of eye covers or the common first cover. The bridle also includes a plurality of body covers each around the first and second spanning segments of one of the plurality of endless loops and which comprises a body portion of a leg of the bridle between the eye and the master ring.

One advantage of the sling of the present invention is that it may be utilized in places where operating space is limited.

Another advantage of the sling of the present invention is that it may be easier for an operator to handle and use due to the reduced weight of the sling.

Another advantage of the present invention is that slings may be manufactured with reduced cost due to the elimination of excess materials from prior designs.

Another advantage of the present invention is that an improved telltale may be provided without excessive additional costs or manufacturing difficulties.

Still another advantage of the present invention is that a bridle can be provided which is lightweight and easy to use.

Still another advantage of the present invention is that a bridle can be provided with an integral master ring.

BRIEF DESCRIPTION OF THE DRAWINGS

The above mentioned and other advantages and objects of this invention, and the manner of attaining them, will become more apparent and the invention itself will be better understood by reference to the following description of embodiments of the invention taken in conjunction with the accompanying drawings, wherein.

Figure 1:
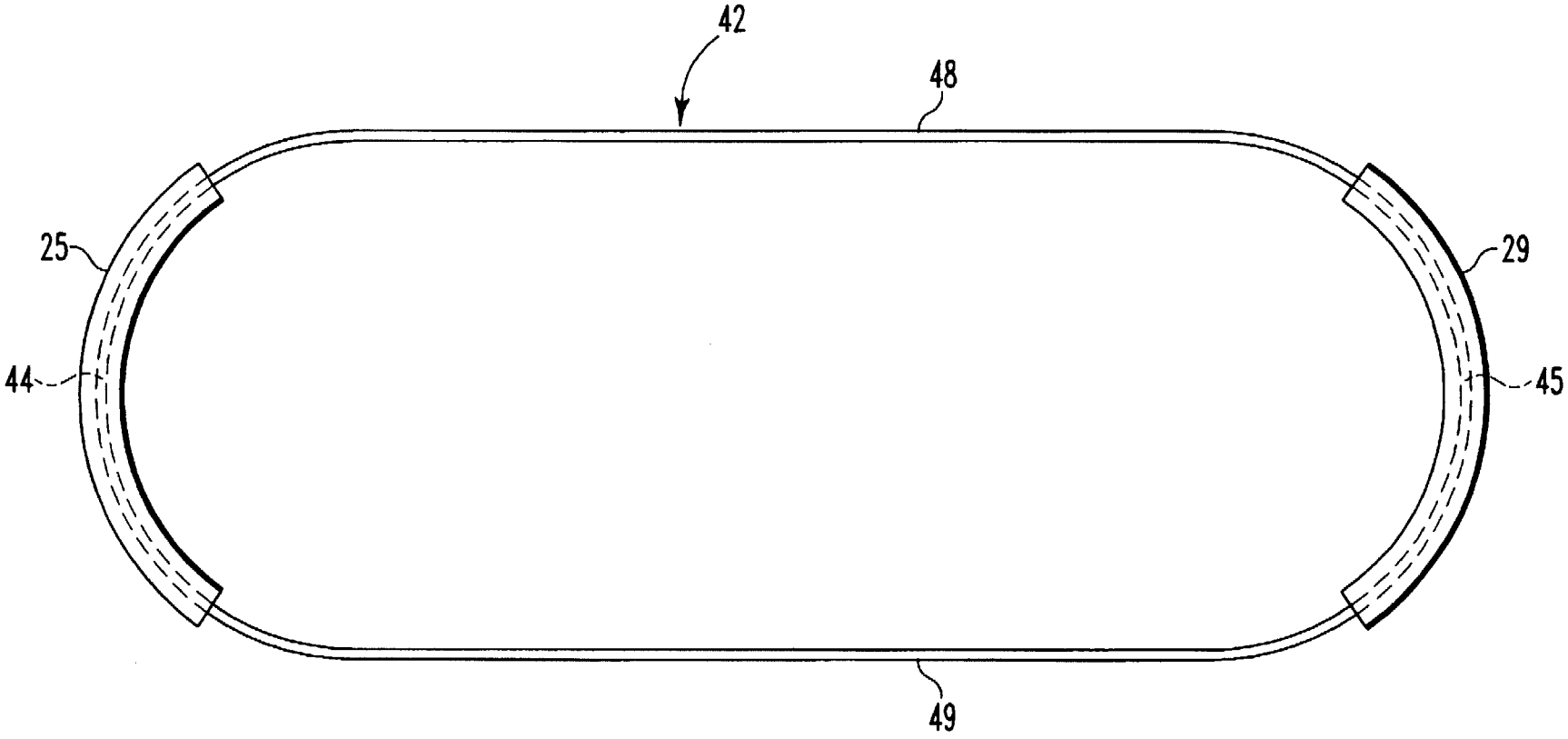
FIG. 1 is a side view of a sling of the present invention at an intermediate stage of its fabrication.

Corresponding reference characters indicate corresponding parts throughout the several views. Although the drawings represent embodiments of the invention, the drawings are not necessarily to scale and certain features may be exaggerated or omitted in order to better illustrate and explain the present invention.

DESCRIPTION OF THE PREFERRED EMBODIMENTS

Referring now to FIG. 1, there is shown a side view of the eye-and-eye sling of the present invention during an intermediate stage of its fabrication. The sling is shown with first and second pieces of seamless, tubular material or fabric 25, 29 being separately arranged on the load bearing cores, generally indicated at 42, 43 (see also FIG. 5). Because FIG. 1 is a side view, core 43 is hidden behind core 42 in FIG. 1. Seamless, tubular materials 25 and 29 are also referenced herein as eye covers as they each form the cover for the load bearing cores of one of the eyes or ends of the finished eye-and-eye sling.

At a central portion of their widths, eye covers 25, 29 are each longitudinally fastened along its entire length to form parallel but separate internal paths for the load bearing cores. The fastening of eye cover 25 is generally indicated at 33 in FIG. 5, and the longitudinal fastening of eye cover 29 is similarly configured. Fastening 33 and additional occasions of fastening mentioned below are typically provided via stitching and therefore may be further referenced as such herein. However, these fastenings alternatively may be done in other conventional methods.

Eye covers 25, 29 may be made from one or more of a variety of durable or rugged flexible materials such as woven polyester or nylon. Eye covers 25, 29 also may be provided with a double thickness, i.e. a first or inner tubular cover within a second or outer tubular cover. A double thickness construction provides greater durability, and, when the inner and outer covers are different colors, a visual indication of sling wear. Although seamless tubular covers are employed within the preferred embodiment, covers may alternatively be formed within the scope of the invention by wrapping fabric or material around a formed load bearing core and stitching the fabric in place. However, because the stitching may unravel over time and the potential resulting exposure of the load bearing cores increases the likelihood of damage to the cores, seamless tubular covers are preferred.

Figure 2:
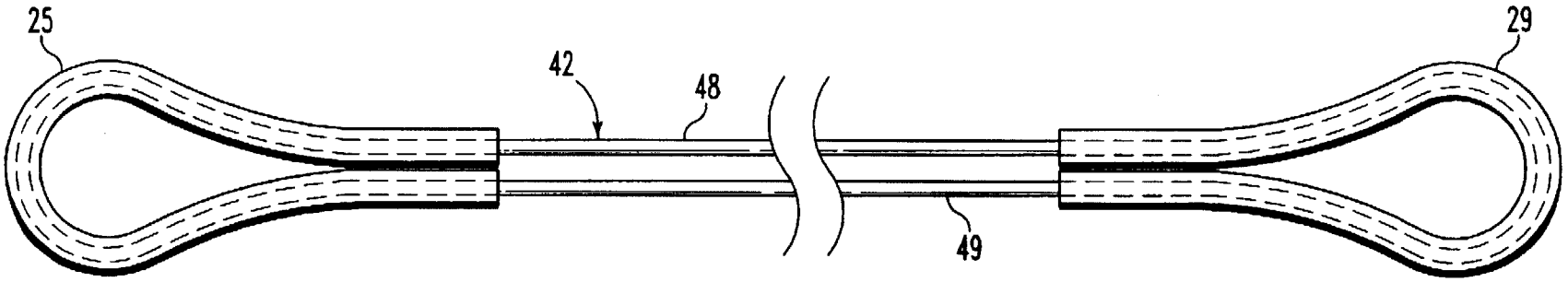
FIG. 2 is a side view of the sling of FIG. 1 after the sling has been manipulated into a cover sleeve-receiving arrangement.

Eye covers 25, 29 are shown positioned more or less at diametrically opposite positions along the loop shape of the load bearing cores. If the eye covers are not exactly diametrically arranged, the sling can still be assembled and will still function, but the opposite ends of each eye cover will not necessarily align when brought together as shown in FIG. 2 during sling assembly.

Figure 5:
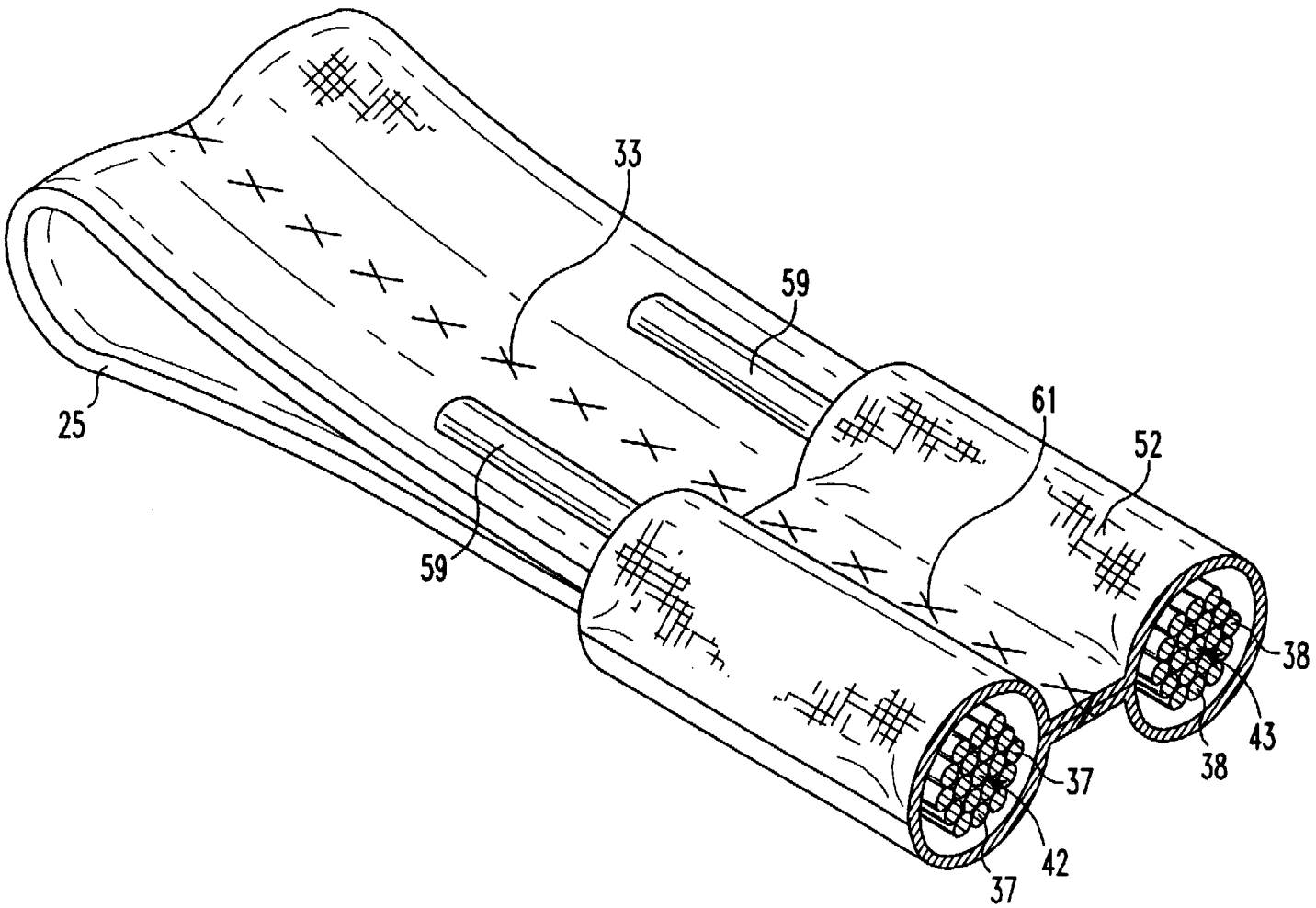
FIG. 5 is a perspective, cross-sectional view, taken along line 5—5 of FIG. 4, of the eye-and-eye sling of the present invention.

Load bearing cores 42, 43 are each in the form of an endless loop having a "length" equal to the circumference, as considered from the perspective of a FIG. 1 viewer, of the loop. In the preferred embodiment, and as best shown in FIG. 5, each of load bearing cores 42, 43 is formed as an endless loop of multiple windings of a single strand of high-tensile strength material, such as Kevlar® or Spectra® or polyester. Other strand materials may alternatively be employed. Core 42 is formed from strand 37, and core 43 is formed from strand 38. The strength of the load bearing cores is a function of the number of windings and the strand material. Each "strand" may itself be formed of numerous fine fibers within the scope of the invention, but the strand may be handled and inserted through the eye covers as a single unit. Other designs for a load bearing core, such as two or more endless loops formed of one or more windings, may alternatively be employed within the scope of the invention.

Each load bearing core includes generally diametrically disposed first and second loop segments indicated with dashed lines at 44, 45, respectively. Loop segments 44, 45 pass through the internal pathways within seamless tubular covers 25, 29. The central length segments of the load bearing cores which span the distance between the facing ends of first and second eye covers 25, 29 are indicated at 48, 49. Spanning segments 48, 49, which in the finished sling typically extend either almost all or at least the majority of the body portion of the sling stretching between the sling eyes, are not covered by any protective cover at this stage of manufacture.

Load bearing cores 42, 43 may be provided within seamless tubular eye covers 25, 29 in multiple ways. For example, a lead end of each of strand 37 and strand 38 first may be hand threaded through the internal paths of covers 25, 29 repeatedly. Each loop or passage of the strand lead ends through the covers results in another strand winding being created for the load bearing cores. The winding of strands 37, 38 through seamless covers 25, 29 may also be performed in a mechanized manner with the aid of machines that are known in the art and commercially available from, for example, I&I Sling Co., Inc. of Aston, Pa. When sufficient strand windings have been achieved to provide the strength required for the sling being formed, the opposite ends of the wound strand 37 (i.e. the lead end and the trail end) are connected such as by being tied together. The opposite ends of wound strand 38 are similarly tied off.

If no telltales as described below are desired, the opposite ends of strands 37, 38 may be tied off to themselves such that neither strand end extends significantly beyond its knotted connection with the other strand end. If telltales are desired, the opposite ends of strand 37 may be tied off, and the opposite ends of strand 38 may be tied off, such that one of the ends of each strand forms a windable telltale extension beyond its knotting having a length described below.

At the next stage of manufacture, the sling in progress is manipulated to a substantially straight or flattened condition such as abstractly shown in FIG. 2. This condition can be achieved by pulling outward on the eye portions of the sling covered by the first and second eye covers 25 and 29.

Figure 3:
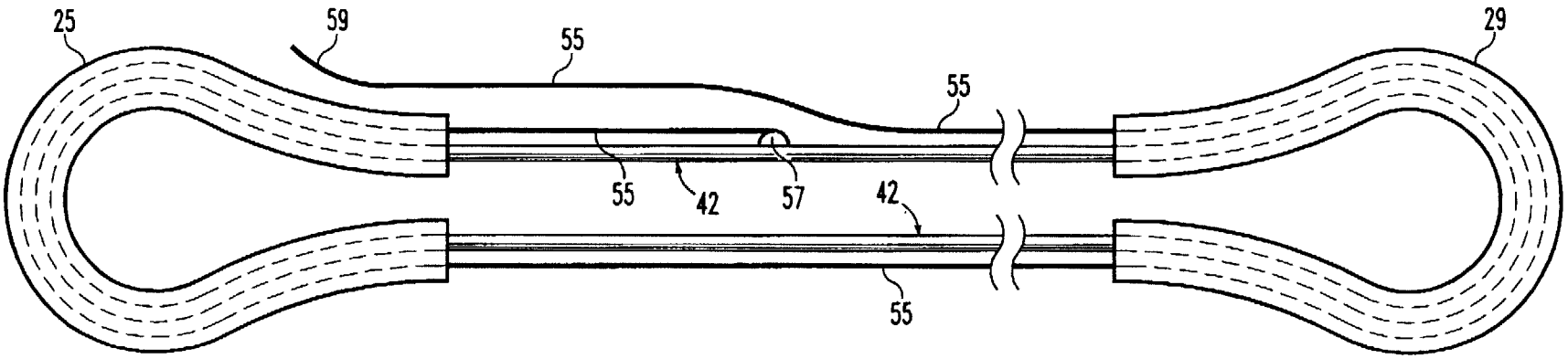
FIG. 3 is a side view, similar to FIG. 2, illustrating a construction of the telltale attached to the load bearing core.

Referring now to FIG. 3, there is shown a side view similar to the view of FIG. 2 wherein the sling being formed is shown including a telltale of the present invention. The tell-tail is a strand 55 of a substantially non-stretchable material. At one end, strand 55 is connected to a point along load bearing core 42 indicated at 57. As in the preferred embodiment strand 55 is formed as an extension of the fibrous strand used to form load bearing core 42, core point 57 represents the knotting together of the lead end of the strand with the trail end of the strand. Alternatively, a separate thread or strand may be attached to the core 42 at some random point along the core circumference. Strand 55 wraps around the entire length or circumference of the endless loop of load bearing core 42 and continues to a point at which end 59 reaches a point above first eye cover 25. Load bearing core 43 also may be provided with a telltail for purposes of providing visual indication of its stretching during use.

Figure 4:
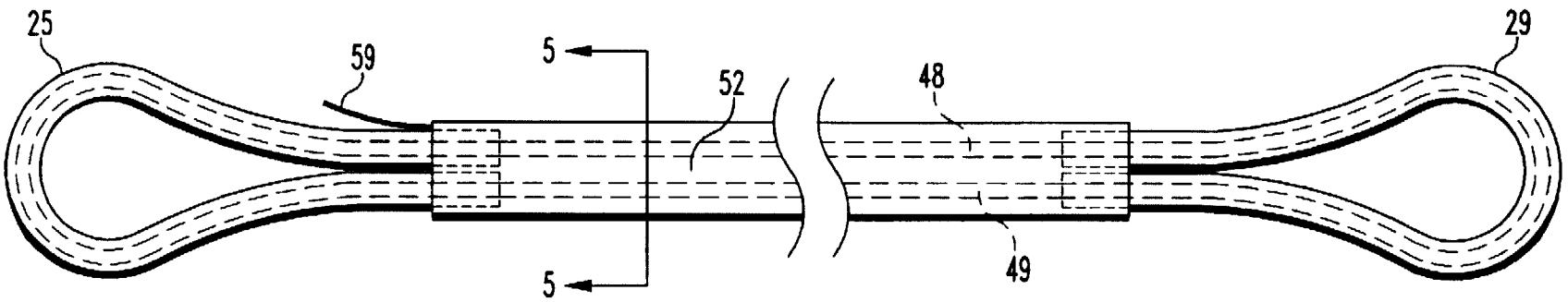
FIG. 4 is a side view of the sling of FIG. 3 after the placement and attachment of the body cover covering the previously exposed spanning segments of the load bearing cores.

Spanning segments 48, 49 are then wrapped or encased within a protective cover as shown in FIG. 4. A preferred manner of achieving the encasement involves pulling a seamless tubular sleeve or body cover 52 over one end of the sling, for example over eye cover 29 and to the left in FIG. 4, and to the position shown in FIG. 4 covering spanning segments 48, 49. Cover sleeve 52 is positioned such that its opposite ends slightly overlap the ends of both first and second eye covers 25, 29 to allow for its fastening to the eye covers. After cover sleeve 52 is so positioned, its central width portion is longitudinally fastened together by stitching, such as abstractly shown at 61 in FIG. 5, to maintain separation of load bearing cores 42, 43. Body cover 52 is typically made of the same flexible material as is eye covers 25 and 29, and also may be formed of a double thickness construction. Alternative flexible body covering materials may also be used. Additional fastening may also be provided at the overlap of body cover 52 and first and second eye covers 25 and 29, for example at the outside portions of the covers, for a secure connection. The fastening processes are carefully performed so as not to damage the load bearing cores.

Referring now to FIG. 5, there is shown a perspective view taken along line 5—5 of FIG. 4 of a finally assembled sling which includes telltales such as shown in FIG. 3. The ends 59 of each telltale 55 project beyond the end of body cover 52 so as to overlay the exterior of first eye cover 25. It will be recognized that in alternate embodiments the telltale ends 59 could overlay other portions of the protective cover so long as they are visible to an operator.

The type of eye-and-eye sling shown being formed in FIGS. 1–5 has two, separate, load bearing cores and is similar in some aspects to slings disclosed in a 1995 brochure entitled Slingmax Rigging Products #9511 by Slingmax Rigging Products of Aston, Pa., which is incorporated herein by reference, and in U.S. Pat. No. 4,850,629, which is incorporated herein by reference. The inventive sling may alternatively be formed with a single core, or possibly even additional separate cores, within the scope of the present invention.

Figure 6:
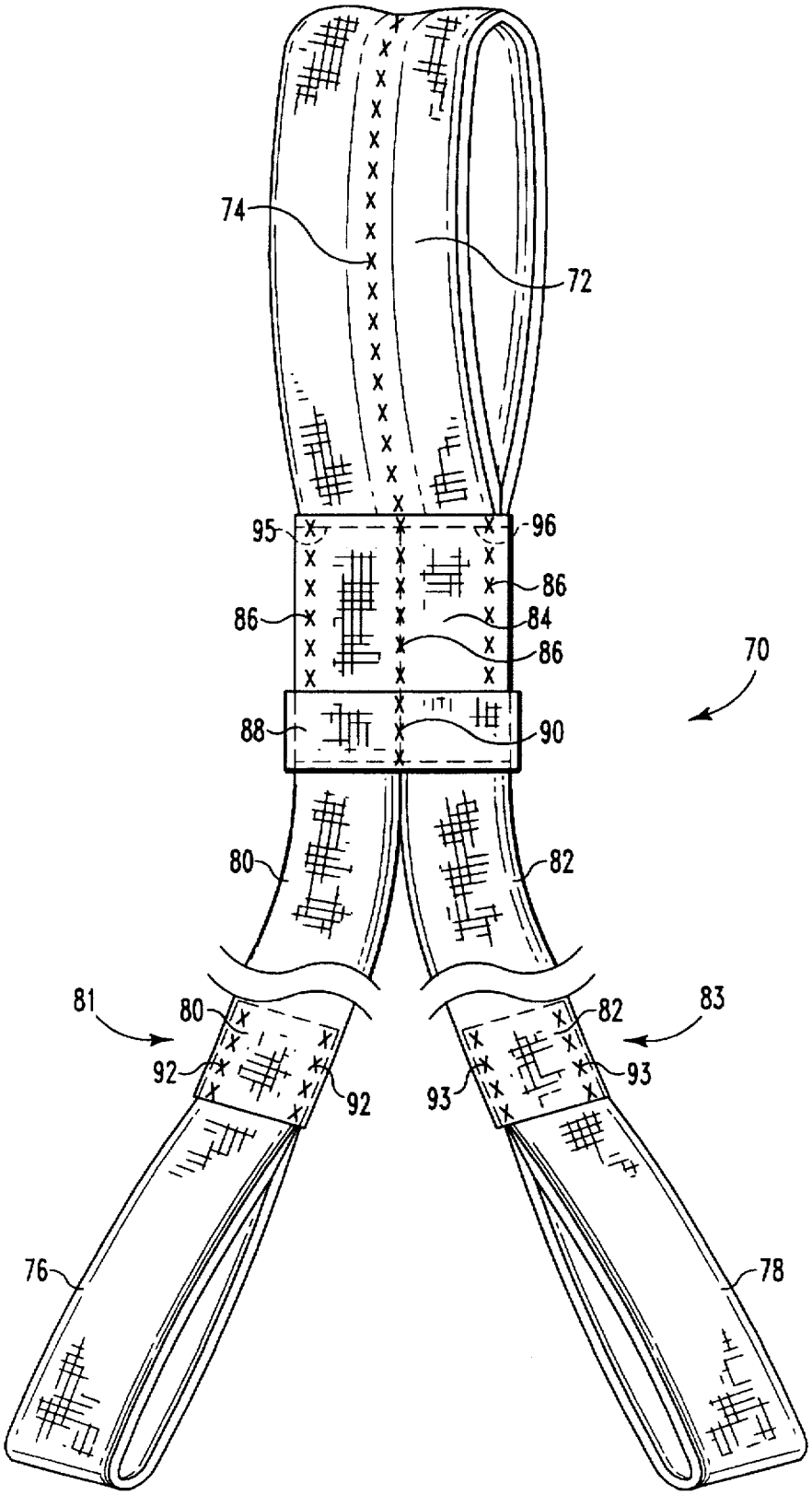
FIG. 6 is a front view of another sling of the present invention configured as a two-leg bridle.

Referring now to FIG. 6, there is shown a bridle, generally designated 70, configured according to the teachings of the present invention and with a portion of its legs removed for illustration purposes. Bridle 70, which is a two-legged bridle, includes a pair of endless loop load bearing cores (not visible) that extend through a common, seamless tubular cover 72 which forms a master eye or ring of the bridle. Longitudinal stitching 74 through cover 72 maintains separation of the cores during and subsequent to their initial insertion during bridle manufacture. The load bearing cores also separately extend through tubular seamless covers 76 and 78. Except for the lack of multiple paths in eye covers 76 and 78, covers 72, 76 and 78 are conceptually similar to the eye covers of the sling of FIG. 4.

Separate seamless tubular body covers 80 and 82, which during bridle assembly are inserted onto and pulled over eye covers 76, 78, respectively, encase or cover the otherwise uncovered spanning segments of the load bearing cores to form part of the bridle legs 81, 83. The upper portion (from the perspective of a FIG. 6 viewer) of body covers 80 and 82 are split such that they may overlay the periphery of the bottom ends of master ring cover 72. The ends of the upper portions of body covers 80, 82 are indicated in dashed lines at 95 and 96. The lower portions of body covers 80 and 82 overlap the upper ends of first and second eye covers 76 and 78, respectively, and can be stitched together as indicated at 92 and 93 for purposes of maintaining the integrity of the bridle during its handling and usage.

Capturing ring 84, for example made of a short piece of seamless tubular material, inserts over the upper portions of tubular covers 80 and 82 and the lower ends of master ring cover 72. Capturing ring 84 can be fastened, such as by stitching indicated at 86, to secure together the cover components. The lower ends of master ring cover 72 are generally coextensive with the bottom edge of ring 84 shown in dashed lines. A reinforcing ring 88, such as made of a strip of material similar to that forming cover 72 and sewn or fastened at 90, surrounds the upper ends of bridle legs 81, 83 at the base of master ring cover 72. Reinforcing ring 88, as well as ring 84, aids in preventing bridle 70 from undesirable tearing when large lateral loads are exerted on the legs 81 and 83 during use.

Although not shown in FIG. 6, telltales configured as shown in FIGS. 3 and 5 may also be provided for each of the bridle load bearing cores within the scope of the present invention.

Although a two-legged bridle is shown, additional bridle legs may be provided within the scope of the invention. However, a two legged bridle achieves a master ring having a size better suited for engagement by many standard sized hooks with which such a bridle may be advantageously utilized. Bridles with larger numbers of legs, unless the cores are made smaller, may not readily fit on some hooks.

While this invention has been shown as having multiple designs, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A sling comprising:

a flexible load bearing core in the form of an endless loop comprising a plurality of windings of a strand of material, said strand of material comprising a first end portion, a second end portion and a length segment between said first and second end portions, wherein said first end portion is fixedly attached to said length segment;

a flexible cover means for covering said load bearing core; and telltale means for indicating overstretching of said load bearing core, said telltale means comprising a section of said strand of material between said second end portion and said length segment, wherein said section extends around at least the entire length of said loop, wherein an end of said second end portion extends from said cover means and is pulled into said cover means to be hidden from a user upon core overstretching.

2. A multi-leg bridle comprising:

a plurality of flexible load bearing cores in the form of endless loops each comprising a plurality of windings of a strand of material, said endless loops each comprising a length including a first loop segment, a second loop segment, a first spanning segment extending between first ends of said first and second loop segments, and a second spanning segment extending between second ends of said first and second loop segments, wherein said first and second loop segments at least comprise substantially diametrically disposed portions of said endless loop;

a common first cover covering said first loop segments of each of said plurality of endless loops and forming a master ring of said bridle, said first and second spanning segments of each of said plurality of endless loops being uncovered by said common first cover;

a plurality of eye covers each covering one of said second loop segments of said plurality of endless loops and forming an eye of a leg of said bridle, said first and second spanning segments of each of said plurality of endless loops being uncovered by said plurality of eye covers; and a plurality of body covers each around both of said first and second spanning segments of one of said plurality of endless loops and comprising a body portion of a leg of said bridle between said eye and said master ring, each of said body covers comprising an interior surface in direct facing relationship with said strand of material windings of said first and second spanning segments of the endless loop it covers.

3. The bridle of claim 2 wherein said plurality of flexible load bearing cores consists of two flexible load bearing cores, whereby said bridle consists of a two-legged bridle.

4. The bridle of claim 2 further comprising a reinforcing ring encircling an interconnection of said plurality of body covers and said common first cover.

5. A multi-leg bridle comprising:

a plurality of flexible load bearing cores in the form of endless loops, said endless loops each comprising a length including a first loop segment, a second loop segment, a first spanning segment extending between first ends of said first and second loop segments, and a second spanning segment extending between second ends of said first and second loop segments, wherein said first and second loop segments at least comprise substantially diametrically disposed portions of said endless loop;

a common first cover covering said first loop segments of each of said plurality of endless loops and forming a master ring of said bridle, said first and second spanning segments of each of said plurality of endless loops being uncovered by said common first cover;

a plurality of eye covers each covering one of said second loop segments of said plurality of endless loops and forming an eye of a leg of said bridle, said first and second spanning segments of each of said plurality of endless loops being uncovered by said plurality of eye covers;

a plurality of body covers each around said first and second spanning segments of one of said plurality of endless loops and comprising a body portion of a leg of said bridle between said eye and said master ring; and a reinforcing ring encircling an interconnection of said plurality of body covers and said common first cover.

* * * * *